US006725951B2

(12) United States Patent
Looper

(10) Patent No.: US 6,725,951 B2
(45) Date of Patent: Apr. 27, 2004

(54) EROSION RESISTENT DRILLING HEAD ASSEMBLY

(75) Inventor: Patrick M. Looper, Odessa, TX (US)

(73) Assignee: Diamond Rotating Heads, Inc., Odessa, TX (US)

( * ) Notice: Subject to any disclaimer, the term of this patent is extended or adjusted under 35 U.S.C. 154(b) by 0 days.

(21) Appl. No.: 09/964,057

(22) Filed: Sep. 27, 2001

(65) Prior Publication Data

US 2003/0056992 A1 Mar. 27, 2003

(51) Int. Cl.[7] ..... E21B 19/24
(52) U.S. Cl. ..... 175/195; 166/84.3; 166/89.1
(58) Field of Search ..... 175/195, 209, 175/214; 166/84.3, 84.1, 88.1, 89.1, 78.1

(56) References Cited

U.S. PATENT DOCUMENTS 3,400,938 A 9/1968 Williams
4,480,703 A * 11/1984 Garrett ..... 175/195
4,502,534 A * 3/1985 Roche et al. ..... 166/84.4
5,662,181 A 9/1997 Williams
6,263,982 B1 * 7/2001 Hannegan et al. ..... 175/7
6,354,385 B1 * 3/2002 Ford et al. ..... 175/195

* cited by examiner

*Primary Examiner*—Zakiya Walker
(74) *Attorney, Agent, or Firm*—Wyatt, Tarrant & Combs, LLP

(57) ABSTRACT

A rotary drilling head assembly for a well bore, including an erosion resistant bowl apparatus. The bowl comprises a bowl member, the bowl member having a central receiving cavity configured to receive a rotary sealed bearing assembly, the bowl member having a discharge nozzle extending therefrom, the discharge nozzle fluidly communicating with the receiving cavity, and at least one diverter member extending from an inner surface of the receiving cavity of the bowl, the diverter member formed and configured to disrupt patterns of fluid flow within the bowl during drilling operations. The apparatus preferably includes at least one nozzle diverter member extending from an inner surface of the discharge nozzle. A plurality of diverter members preferably extend from an inner surface of the receiving cavity of the bowl and from the discharge nozzle.

39 Claims, 13 Drawing Sheets

EROSION RESISTENT DRILLING HEAD ASSEMBLY

STATEMENT REGARDING FEDERALLY SPONSORED RESEARCH OR DEVELOPMENT

Not Applicable

FIELD OF THE INVENTION

The present invention relates to drilling head assemblies used in drilling oil wells and the like. More particularly, this invention relates to reduction of erosion in bowls of drilling head assemblies.

BACKGROUND OF THE INVENTION

The present invention relates to and improves upon prior art drilling head assemblies, such as the drilling head assembly of U.S. Pat. No. 3,400,938 (Williams), the disclosure of which is incorporated herein by reference. Prior art drilling head assemblies disclose the use of a stationary housing or bowl member. The bowl member has open upper and lower ends, and a central receiving cavity configured to receive and support a rotary sealed bearing assembly. The configuration of the bowl includes a means for attaching the device to a casing or other oil and gas well component at the surface of the well bore, such as by a conventional flange and bolt arrangement. The bowl member has a discharge nozzle extending therefrom. The discharge nozzle fluidly communicates with the receiving cavity, such that during drilling operations, fluid and airborne particles discharged from the drill string pass through the bowl.

A rotary sealed bearing assembly is supported by the stationary housing. The sealed bearing assembly includes a rotatable sleeve member housed within a stationary sleeve member. The rotatable sleeve member includes a means for driving a drill string via a drilling Kelly, as detailed in e.g. U.S. Pat. No. 3,400,938. A bearing assembly is interposed between the rotatable and stationary sleeves. A chamber is provided between the sleeves for receiving a lubricating fluid. Upper and lower sealing members are provided for preventing leakage of fluid from the fluid chamber and bearing assembly. An auxiliary seal means can be provided for additional protection of the bearing assembly. A quick release clamp is provided for facilitating installation and assembly of the drilling head assembly at a well site. The clamp is configured to encircle an upper end of the stationary housing and an outer circumference of the stationary sleeve.

One problem encountered with prior art drilling head assemblies is erosion of the bowl component of the apparatus. During drilling operations, fluids and airborne solids are discharged from the well bore through the bowl and the discharge nozzle of the bowl, typically at high velocities and pressures. The discharged fluids and airborne solids erode the inner surface of the bore and the bore nozzle. During drilling operations, the discharged fluids and airborne solids tend to form vortexes or other regular patterns of flow within the bowl. These vortexes and flow patterns accelerate erosion in particular regions of the bore and bore nozzle.

Similar erosion problems are encountered in centrifuge pumps. To reduce or eliminate erosion, centrifuge pumps are provided with interior diverters or baffles that serve to break up the flow of fluids, minimizing the formation of vortexes and other patterns of flow. As far as the inventor is aware, diverters have not been applied to the drilling head assembly art. Accordingly, there is a need for a bowl member and a drilling head assembly having the following characteristics and properties.

OBJECTS AND SUMMARY OF THE INVENTION

It is an object of the invention to provide an erosion resistant bowl apparatus for use in a drilling head assembly.

It is an object of the invention to provide a drilling head assembly that includes diverters for breaking up the flow of current within the drilling head assembly and thereby preventing erosion of the bowl and discharge nozzle components of the drilling head assembly.

It is another object of the invention to provide a rotary sealed bearing assembly for a drilling head assembly that does not require preloading of the bearing assemblies.

It is still another object of the invention to provide an improved means of sealing bearing assemblies to prevent loss of lubricant.

These and other objects and advantages of the invention shall become apparent from the following general and preferred description of the invention.

Accordingly, an erosion resistant bowl apparatus for use in a drilling head assembly for drilling operations is provided comprising, generally, a bowl member, the bowl member having a central receiving cavity configured to receive a rotary sealed bearing assembly, the bowl member having a discharge nozzle extending therefrom, the discharge nozzle fluidly communicating with the receiving cavity, and at least one diverter member extending from an inner surface of the receiving cavity of the bowl, the diverter member formed and configured to disrupt patterns of fluid flow within the bowl during drilling operations.

The apparatus preferably includes at least one nozzle diverter member extending from an inner surface of the discharge nozzle. First and a second nozzle diverters may extend from an inner surface of the discharge nozzle, and the first and second nozzle diverters are preferably positioned on opposing upper and lower inner surfaces of the discharge nozzle.

A plurality of diverter members preferably extend from an inner surface of the receiving cavity of the bowl, the diverter members formed and configured to disrupt patterns of fluid flow within the bowl during drilling operations. A central diverter preferably extends from an inner surface of the receiving cavity, the central diverter positioned at about 180 degrees from a central axis of the discharge nozzle. A pair of first and second lower diverters preferably extend from a lower portion of the inner surface of the receiving cavity on opposing sides of the discharge nozzle. A pair of first and second upper diverters preferably extend from an upper portion of the inner surface of the receiving cavity on opposing sides of the discharge nozzle. The upper diverters are preferably closer to the central diverter than the lower diverters. In a preferred embodiment, the first and second lower diverters are positioned at about 45 and 315 degrees, respectively, relative to the central axis of the discharge nozzle, while the first and second upper diverters are positioned about 60 and 300 degrees, respectively, relative to the central axis of the discharge nozzle.

The erosion resistant bowl is used in a rotary drilling head assembly for a well bore. A rotary sealed bearing assembly is supported by the bowl. The rotary sealed bearing assembly comprises a rotatable sleeve member, a stationary sleeve member surrounding the rotatable sleeve, a chamber provided between the stationary sleeve and the rotatable sleeve for receiving a lubricating fluid, a bearing means interposed between the stationary sleeve and the rotatable sleeve and disposed within the chamber, an upper and lower sealing means carried by the stationary sleeve and providing a seal for the chamber to substantially preclude leakage of fluid into or out of the chamber.

PREFERRED EMBODIMENTS OF THE INVENTION

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes maybe made without departing from the scope of the present invention.

Figure 1:
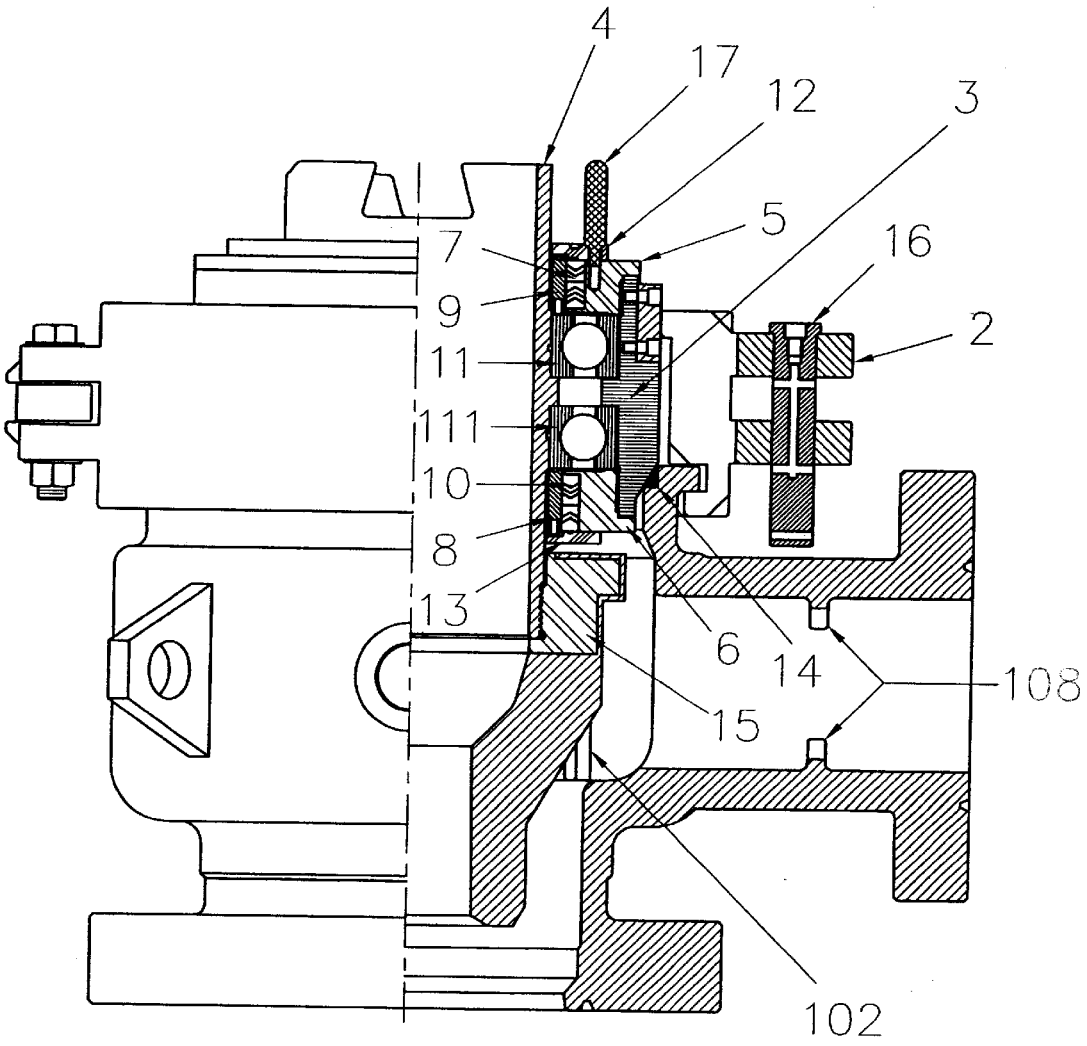
FIG. 1 is a side view of one preferred embodiment of a drilling head assembly of the invention, featuring a partial cross-section showing details of the assembly.

As shown in FIG. 1, the drilling head assembly of the invention includes an improved erosion resistant stationary housing or bowl member 1. As shown most clearly in FIG. 2, the bowl member 1 has an interior bore extending substantially vertically therethrough. A central receiving cavity 1A is formed in an upper region of the bore. The bowl 1 is configured to receive and support a rotary sealed bearing assembly 3–13 within the receiving cavity 1A, in a manner described in further detail below. An upper circumferential opening provides access to the central receiving cavity 1A. An annular shoulder is formed on an inner circumferential edge of the upper opening. A circumferential recess is formed in the beveled shoulder. As shown in FIG. 1, a packing ring or bowl gasket 14 is fitted into the circumferential recess. The configuration of the bowl 1 includes a means for attaching the bowl 1 to a casing or other oil and gas well component at the surface of the well bore, such as by a conventional flange and bolt arrangement on the bottom of the bowl. The bowl member 1 has a discharge nozzle 40 extending therefrom. The discharge nozzle 40 fluidly communicates with the receiving cavity 1A, such that during drilling operations, fluid and airborne particles discharged from the drill string pass through the bowl 1.

The foregoing components of the bowl 1 are widely known in the art. However, as shown in FIGS. 2–5, the bowl 1 of the present invention additionally includes a plurality of internal diverters or baffles 102, 104, 106, 108. The diverters serve as dams to break up vortexes and other flow patterns of discharged fluids and airborne particles that ordinarily form in drilling head assemblies during operation. By breaking up the flow patterns, the diverters 102, 104, 106, 108 reduce erosion of the bowl 1 and the discharge nozzle 40. The diverters are preferably die-cast as an integral part of the stationary bowl 1 and the nozzle 40.

Figure 3:
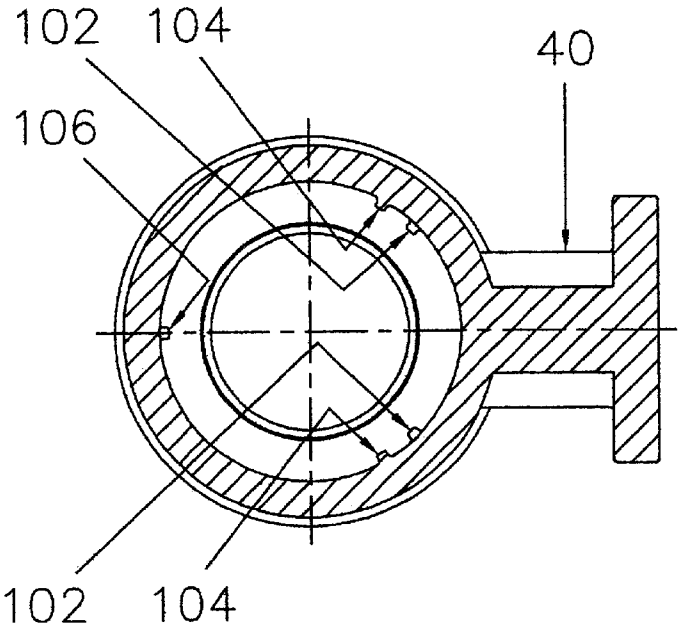
FIG. 3 is a top view cross-section taken along B—B of FIG. 2, featuring the positioning and configuration of diverter members in the bowl and discharge nozzle.

FIGS. 2–5 show preferred configurations and positions of diverters 102, 104, 106, 108. In the preferred embodiment shown in FIG. 3, a central diverter 106 is preferably positioned at about 180 degrees from the central axis of the discharge nozzle 40. In the preferred embodiment shown in FIGS. 2 and 3, a pair of first and second lower diverters 102 are positioned on opposing sides of the cavity of the bowl 1, adjacent the inlet for the discharge nozzle 40. As shown in FIG. 3, the first and second lower diverters 102 are preferably positioned at about 45 and 315 degrees relative to the central axis of the discharge nozzle 40. In the preferred embodiment shown in FIGS. 2 and 3, a pair of first and second upper diverters 104 are positioned on opposing sides of the cavity of the bowl 1, between the central diverter 106 and the lower diverters 102. The upper diverters 104 are preferably positioned adjacent the lower diverters 102. As shown in FIG. 3, the first and second upper diverters 104 are preferably positioned at about 60 and 300 degrees, respectively, relative to the central axis of the discharge nozzle 40.

Figure 5B:
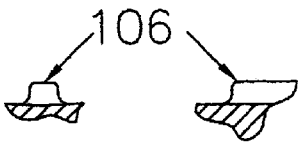
FIG. 5B is a detail view of preferred configurations of diverter members of a receiving cavity of a bowl.
Figure 5A:
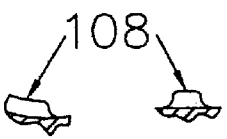
FIG. 5A is detail view of preferred configurations of diverter members of a discharge nozzle.
Figure 4:
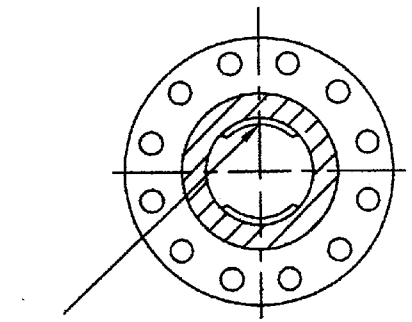
FIG. 4 is a side view cross-section taken along C—C of FIG. 2, featuring the positioning and configuration of diverter members within the discharge nozzle.

As shown in FIG. 4, a pair of upper and lower nozzle diverters 108 are preferably positioned in the discharge nozzle 40. Due to the annular configuration of the discharge nozzle 40, the nozzle diverters 108 preferably have a circumferential outer edge, as shown most clearly in FIG. 4. FIG. 5A shows details of the configuration of the nozzle diverters 108.

Figure 2:
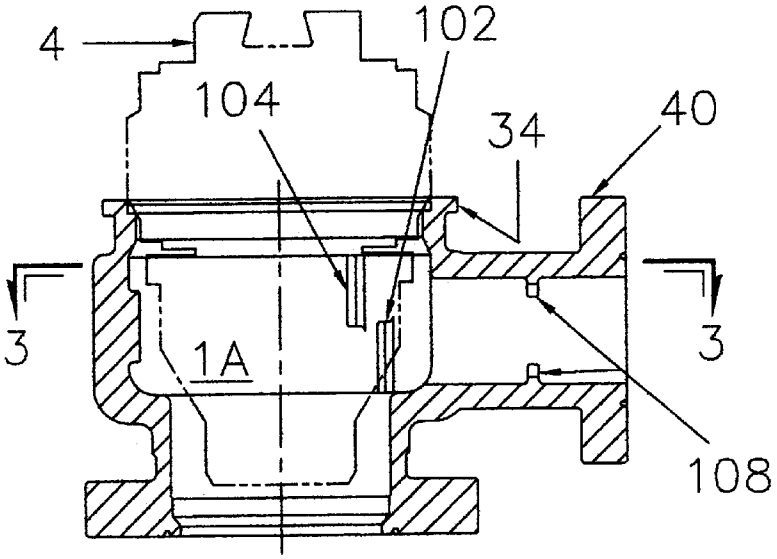
FIG. 2 is a side view cross-section of one preferred embodiment of a bowl for a drilling head assembly of the invention, featuring the positioning and configuration of diverter members in the receiving cavity of the bowl and in the discharge nozzle.

The preferred diverter positions shown in FIGS. 2, 3, and 4 are merely exemplary. Additional or fewer diverters can be employed, and the diverters can be placed in locations other than those shown in FIGS. 2, 3 and 4, provided that the diverters are formed and positioned to disrupt the vortexes and other flow patterns that ordinarily form in drilling head assemblies during drilling operations.

As shown in FIG. 1, a rotary sealed bearing assembly is supported by the bowl. The rotary sealed bearing assembly includes a rotatable bearing sleeve member 4 rotatably housed within a stationary bearing housing 3, which is a sleeve member 3. As shown in FIG. 1, a bearing assembly 11, 111 is interposed between the rotatable bearing sleeve member 4 and the stationary bearing housing 3. A chamber is provided between the bearing sleeve 4 and the bearing housing 3 for receiving a lubricating fluid, which serves to lubricate the bearings 11. As shown in FIG. 1, upper and lower packing and sealing members are provided for preventing leakage of fluid from the chamber; preferred embodiments of the packing and sealing components are described in further detail below.

Figure 6A:
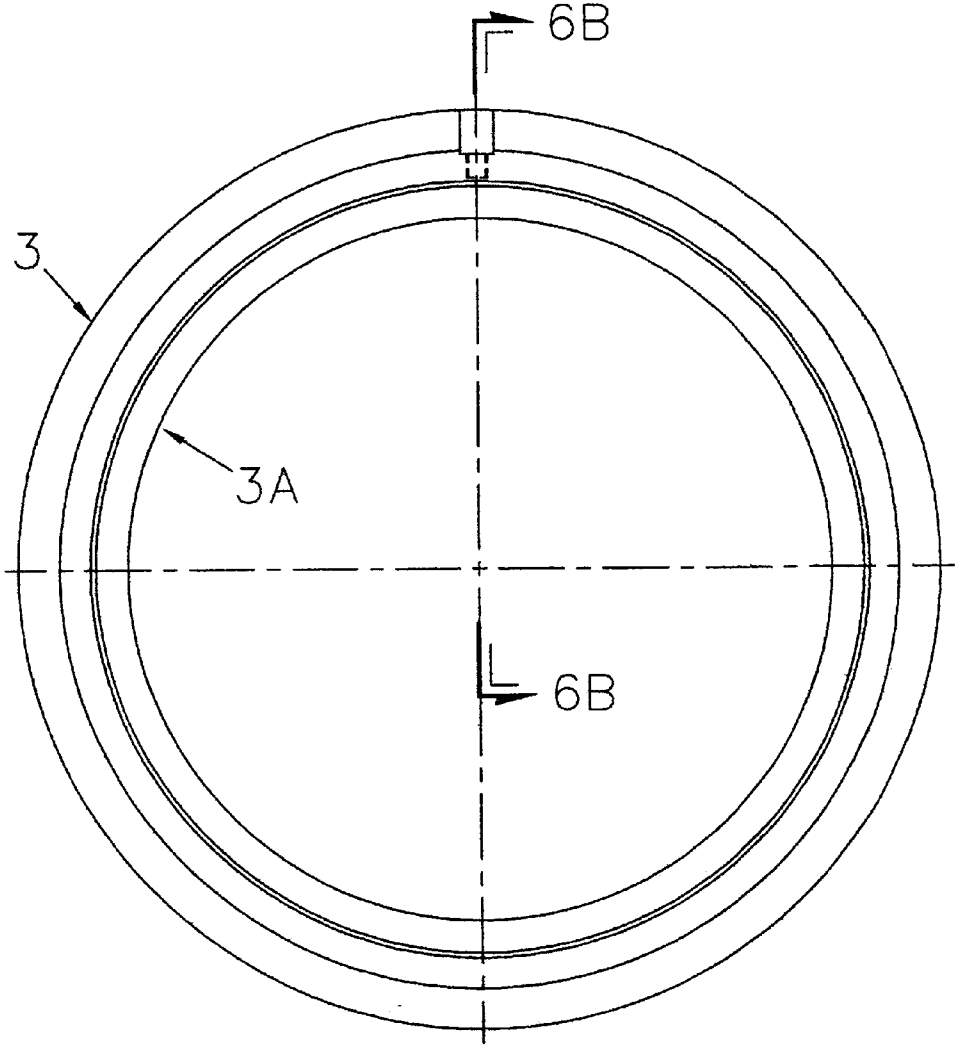
FIG. 6A is a top view of one preferred embodiment of a bearing housing of the invention.
Figure 6B:
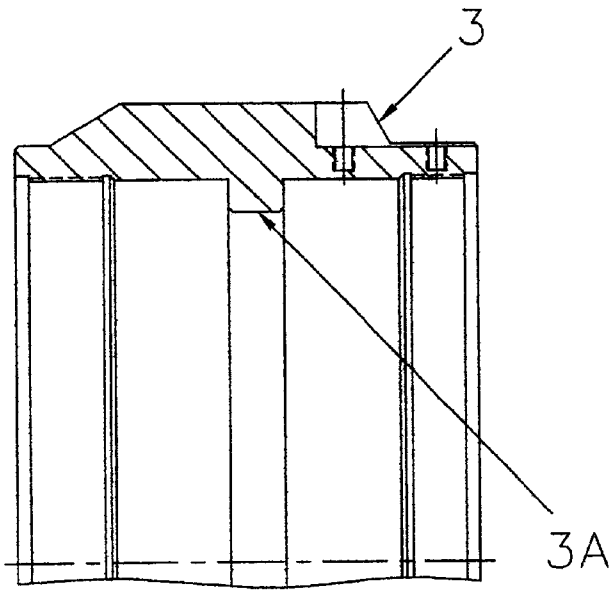
FIG. 6B is a cross-section view taken along A—A of FIG. 6A.
Figure 7:
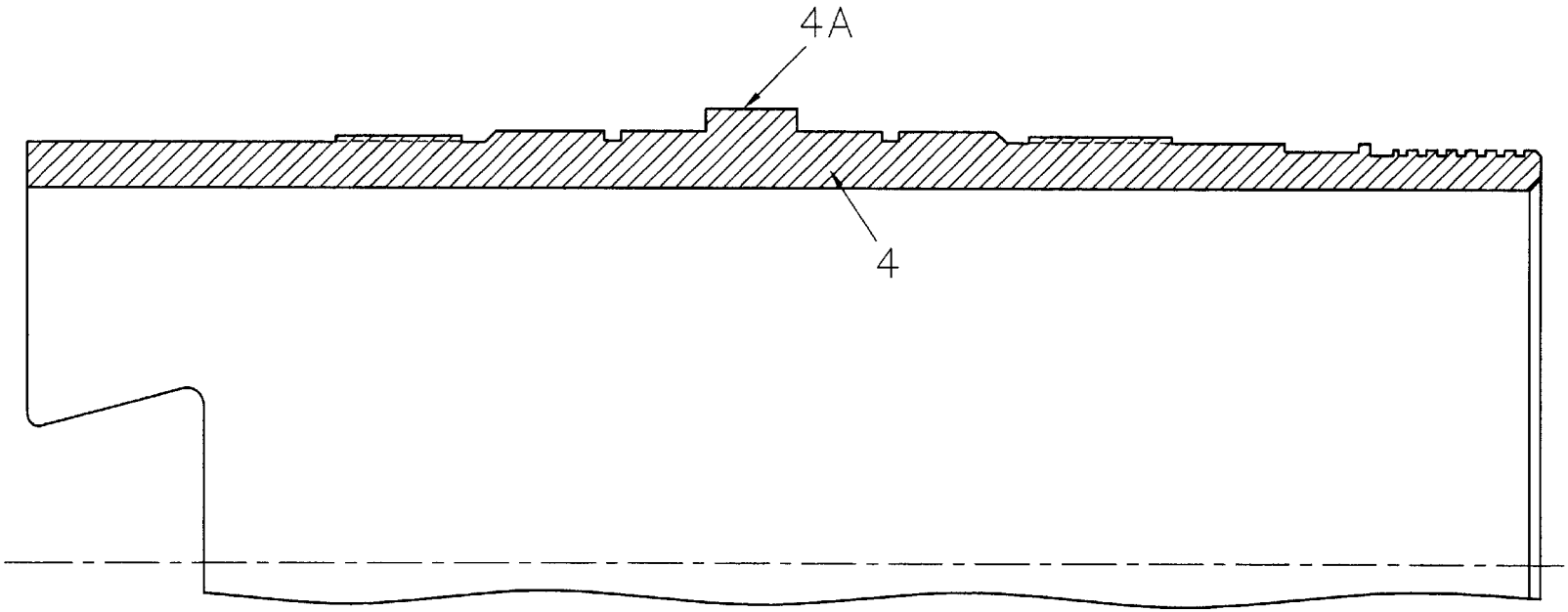
FIG. 7 is a side cross-section view of one preferred embodiment of a bearing sleeve.
Figure 8:
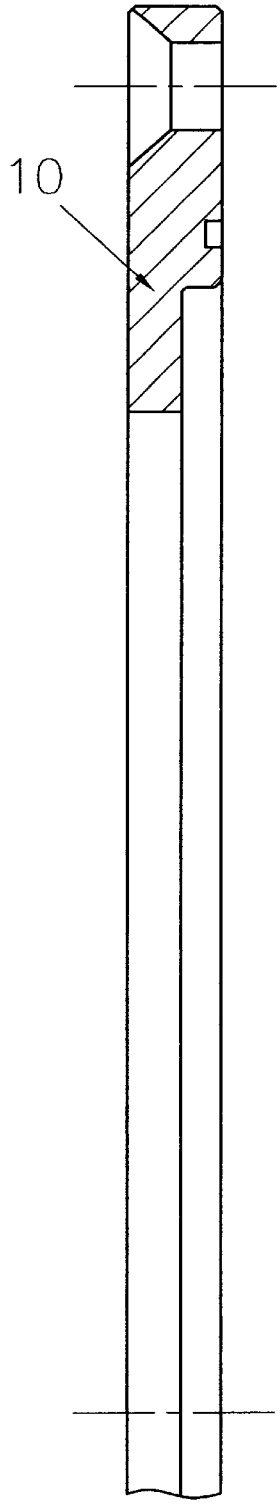
FIG. 8 is a side cross-section view of one preferred embodiment of a lower packing gland.
Figure 9A:
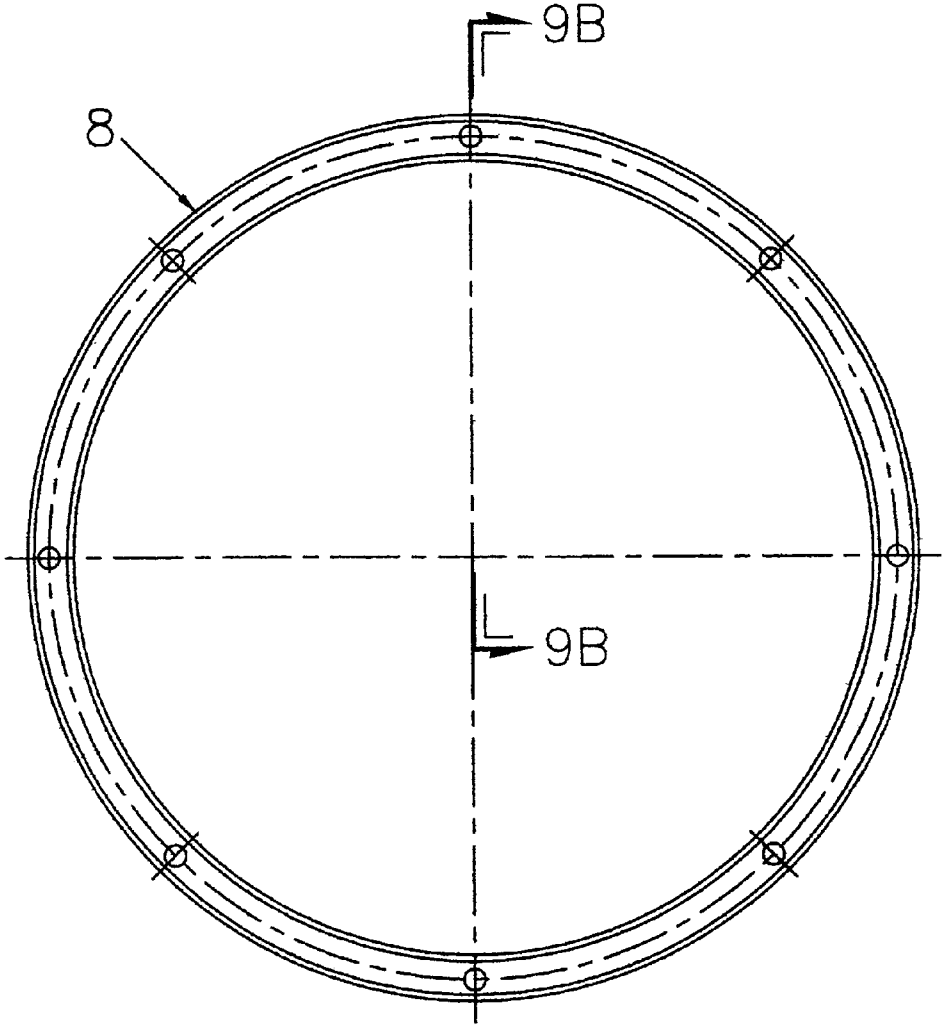
FIG. 9A is a top view of one preferred embodiment of a lower retaining nut.
Figure 9B:
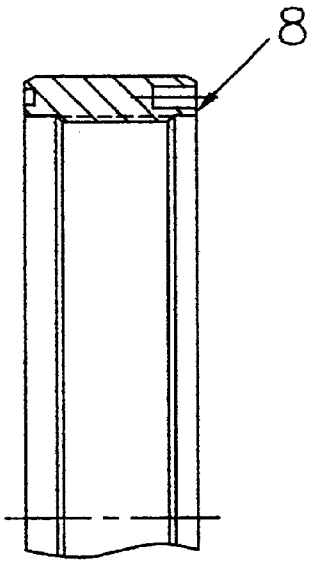
FIG. 9B is a cross-section view taken along A—A of FIG. 9A.
Figure 10A:
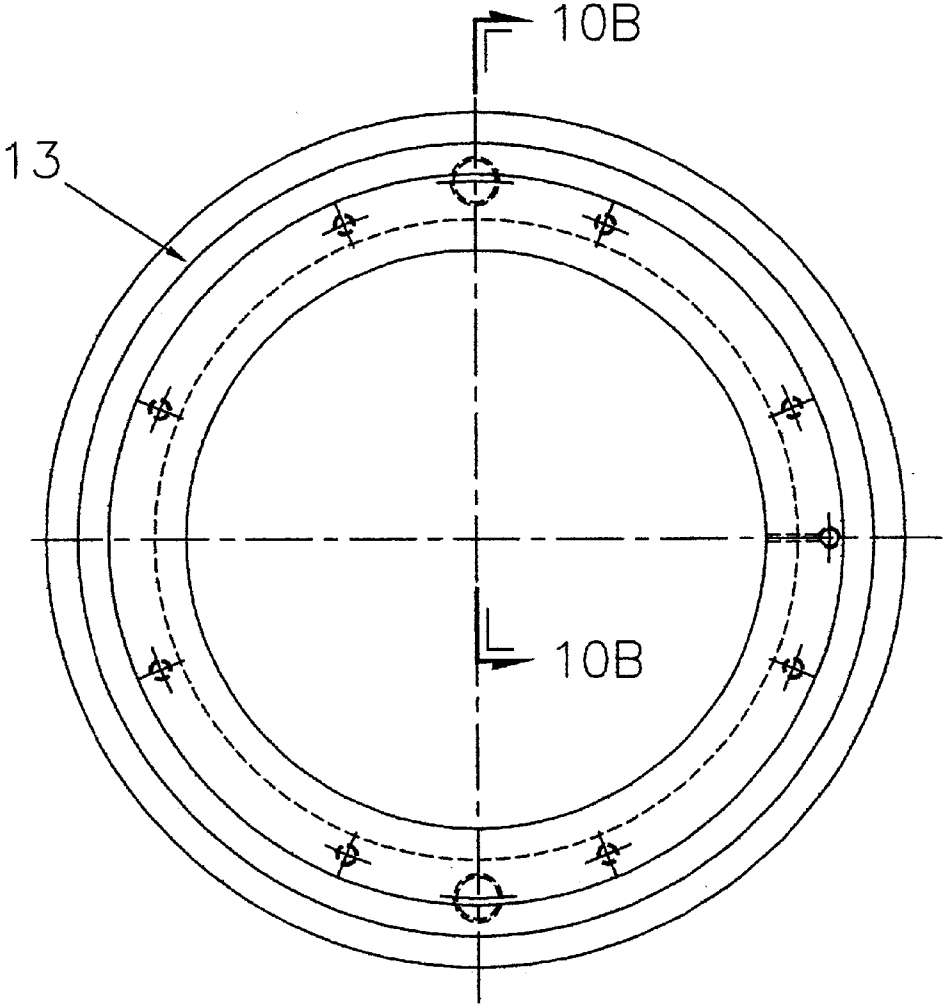
FIG. 10A is a top view of one preferred embodiment of a lower packing box.
Figure 10B:
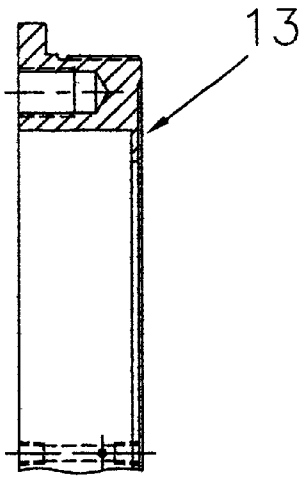
FIG. 10B is a cross-section view taken along A—A of FIG. 10A.
Figure 11A:
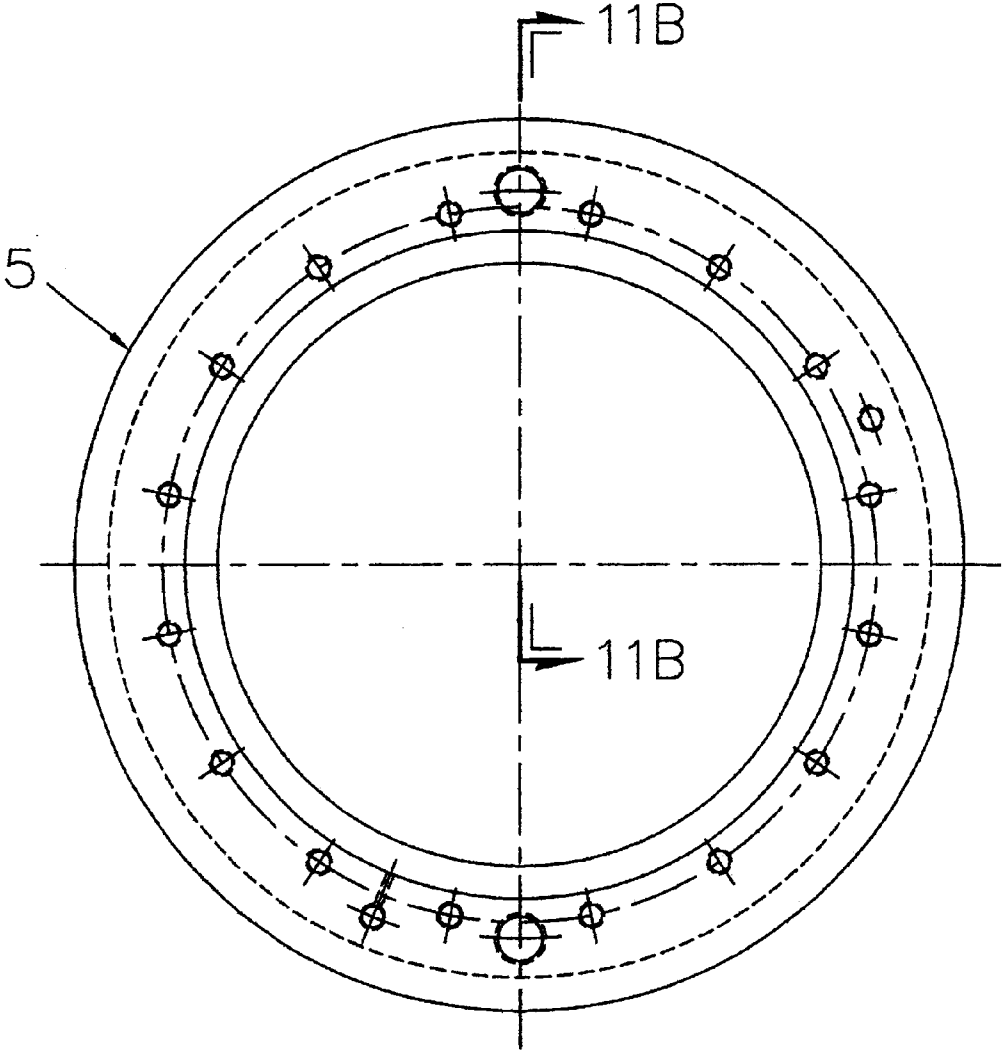
FIG. 11A is a top view of one preferred embodiment of an upper packing box.
Figure 11B:
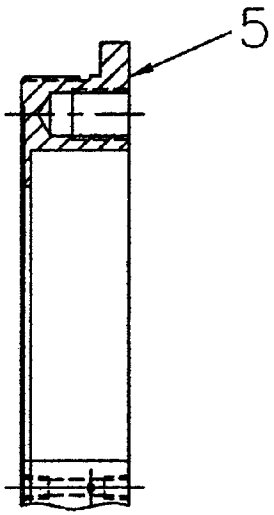
FIG. 11B is a cross-section view taken along A—A of FIG. 11A.
Figure 12A:
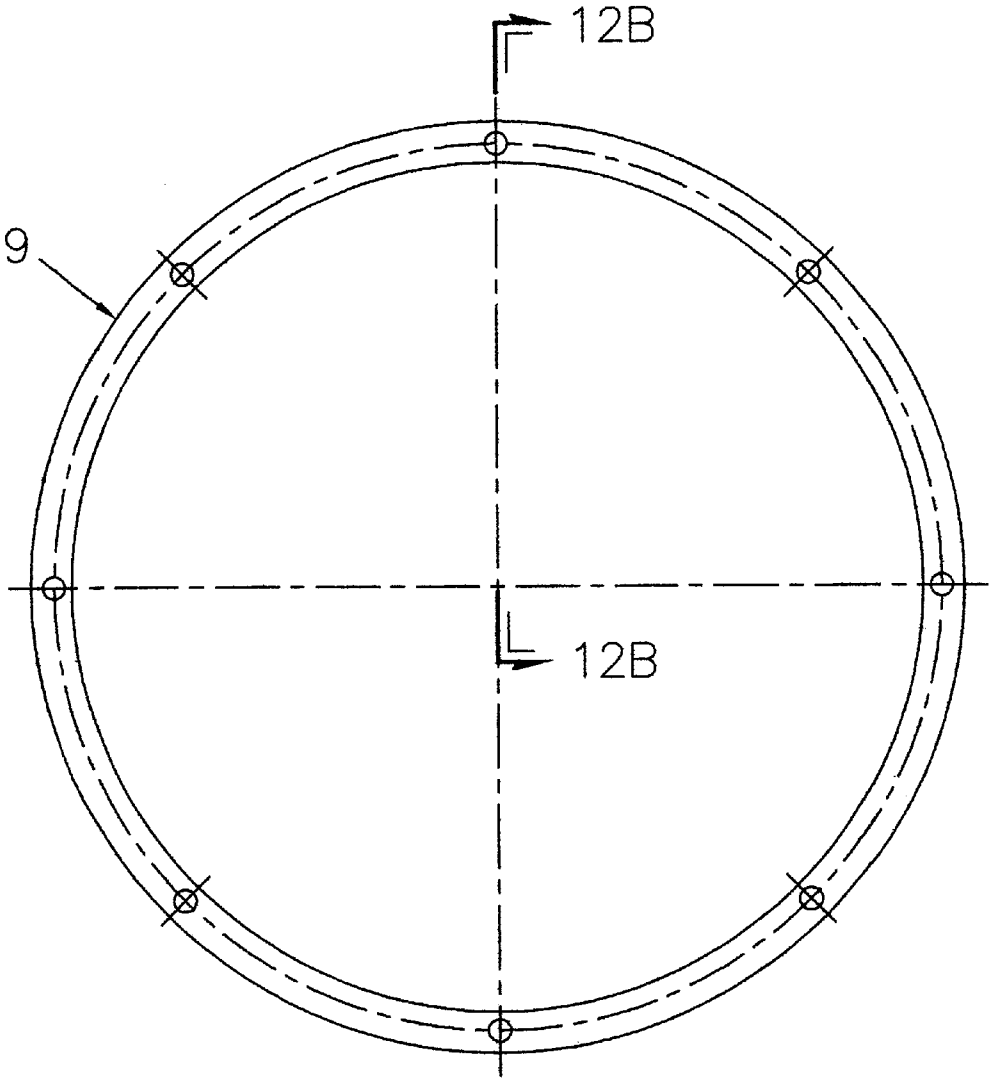
FIG. 12A is a top view of one preferred embodiment of an upper retaining nut.
Figure 12B:
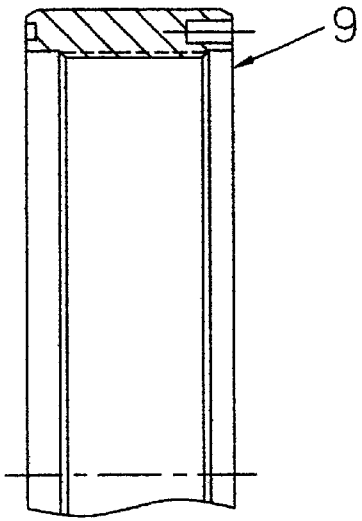
FIG. 12B is a cross-section view taken along A—A of FIG. 12A.
Figure 13A:
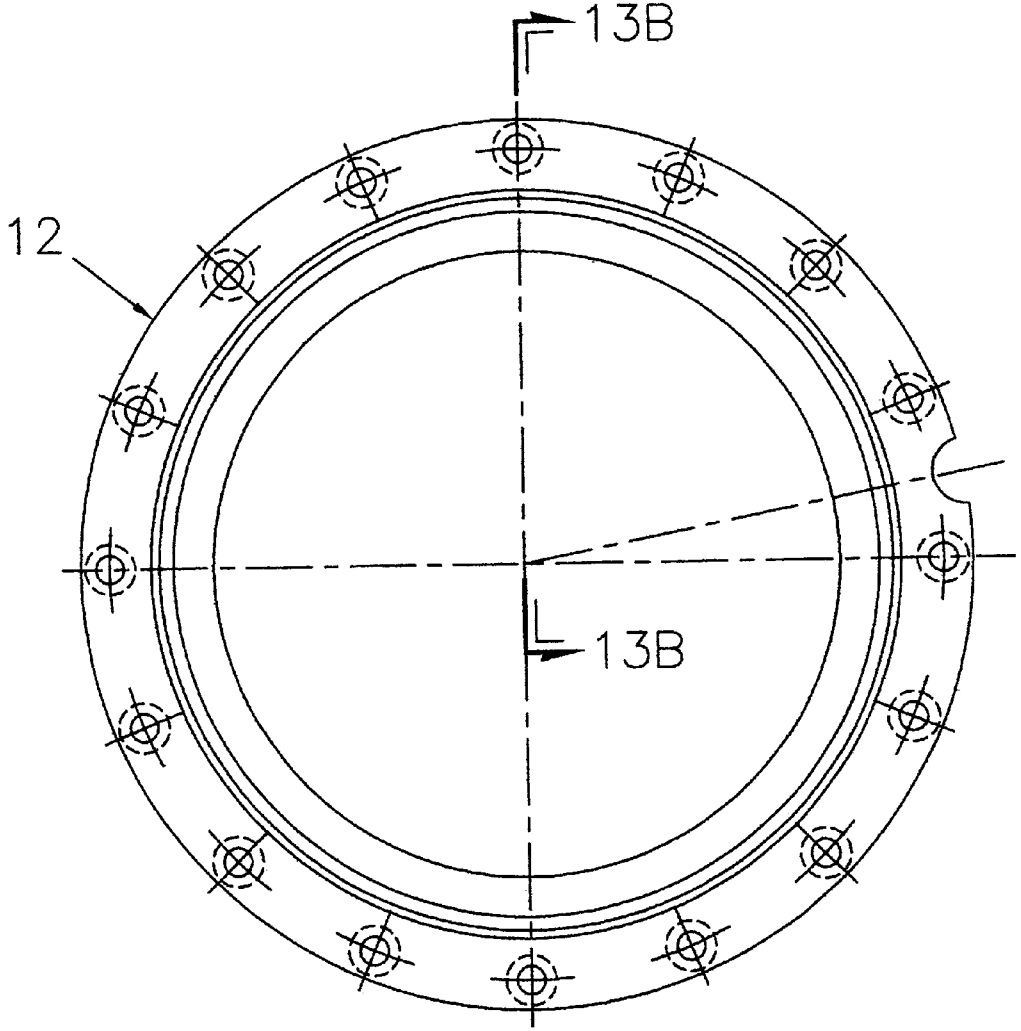
FIG. 13A is a top view of one preferred embodiment of an upper packing gland.
Figure 13B:
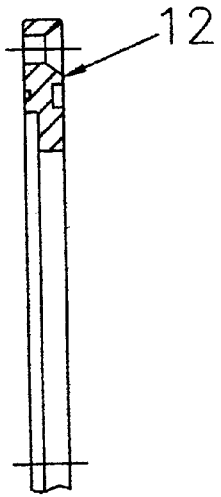
FIG. 13B is a cross-section view taken along A—A of FIG. 13A.

As shown in FIG. 6B, the bearing housing 3 is an open ended cylindrical member. The bearing housing 3 provides support for the rotating and sealing components located within the bearing housing 3. As shown in FIG. 1, during drilling operations, bearing housing 3 is positioned within the receiving cavity 1A of bowl 1. The bearing housing 3 has a circumferential shoulder which rests against the annular shoulder of the bowl 1 when the bearing housing 3 is in position. When the bearing housing 3 is positioned within bowl 1 and the shoulder of housing 3 rests against the shoulder of bowl 1, bowl gasket 14 provides a tight seal between the bowl 1 and bearing housing 3 when they are held together in proper alignment by means of a two section substantially cylindrical clamp assembly 2 (described in further detail below).

The bearing housing may be provided with a conventional sealed bearing assembly, such as the assembly detailed in U.S. Pat. No. 3,400,938, the disclosure of which is incorporated by reference. However, in a preferred embodiment, the apparatus of the present invention incorporates the bearing assembly and sealing arrangement shown in FIGS. 1 and 1A. The rotary sealed bearing assembly of FIG. 1 is less complicated than prior art assemblies, and is therefore easier and less expensive to fabricate, assemble, maintain, and repair.

Figure 1A:
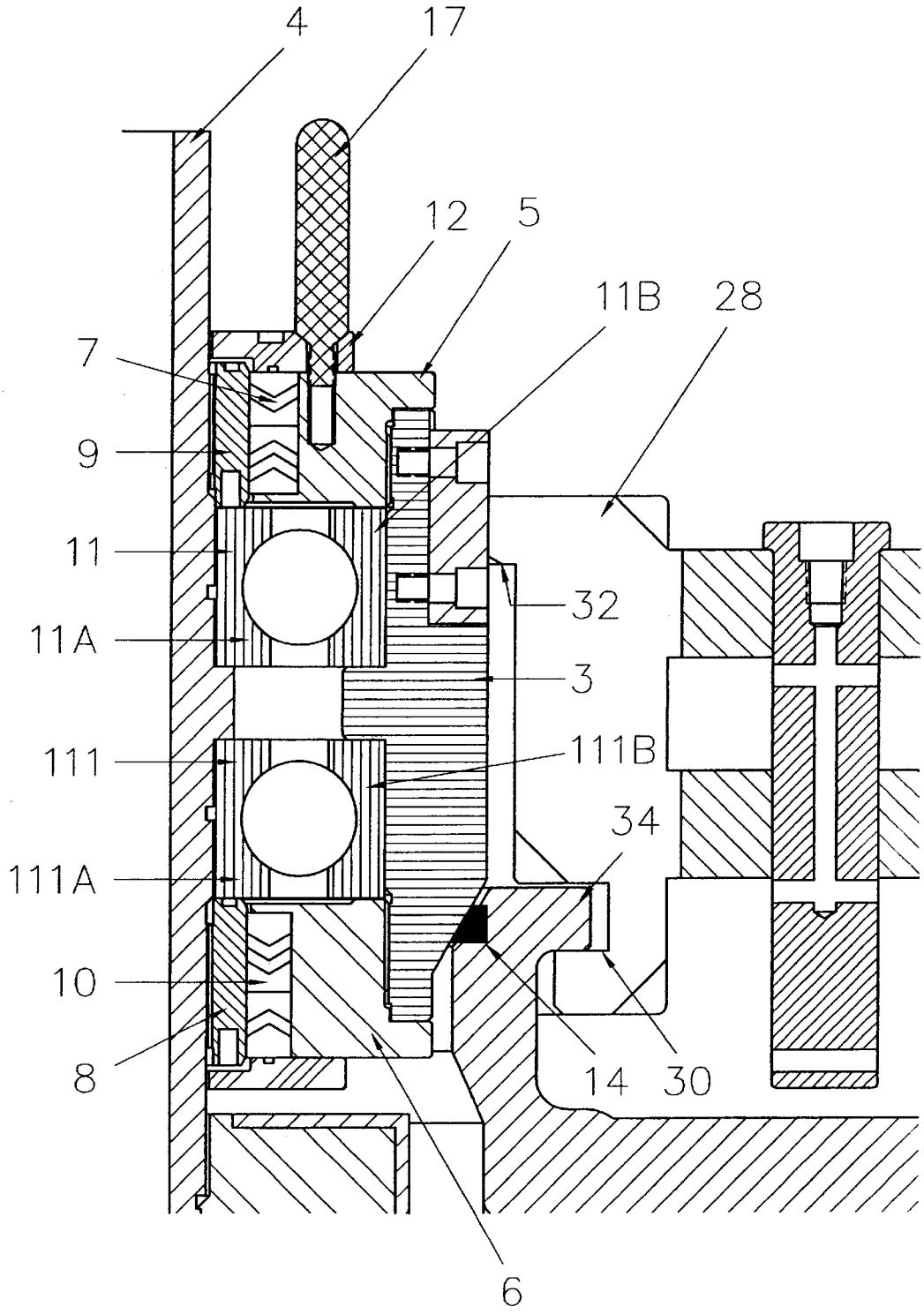
FIG. 1A is a close-up view of the rotary sealed bearing assembly components of FIG. 1.

In the preferred rotary sealed bearing assembly shown in FIG. 1, a pair of upper 11 and lower 111 bearing members (each consisting of bearings 11 sandwiched between inner 11A and outer 11B bearing races) are positioned between bearing sleeve 4 and bearing housing 3, such that the bearing sleeve 4 rotates relative to the stationary bearing housing 3. As mentioned above, a chamber is provided between the bearing sleeve 4 and the bearing housing 3 for receiving a lubricating fluid, which serves to lubricate the bearings 11, 111. As shown in FIGS. 1 and 1A and as described in further detail below, upper and lower packing and sealing members are provided for preventing leakage of lubrication fluid from the chamber of the rotary sealed bearing assembly.

The bearing housing 3 has an inwardly extending shoulder 3A, which serves to support and space the upper outer bearing race 11A and the lower outer bearing race 111A from each other. The bearing sleeve 4 has an outwardly extending shoulder 4A, which serves to support and space the upper inner bearing race 11B and the lower inner bearing race 111B from each other. The bearing housing shoulder 3A and the bearing sleeve shoulder 4A are the same width. As shown in FIG. 1, the upper 11 and lower 111 bearing assemblies are sandwiched around the bearing housing shoulder 3A and the bearing sleeve shoulder 4A. The upper outer bearing race 11B is held against the upper surface of the bearing housing shoulder 3A by an annular upper packing box 5, which is secured to the bearing housing 3. The upper inner bearing race 11A is held against the upper surface of the bearing sleeve shoulder 4A by an annular upper retaining nut 9. An upper packing 7 (preferred embodiments of which are described in further detail below) is interposed between upper retaining nut 9 and the upper packing box 5, to thereby prevent leakage of lubricating fluid from the assembly. An annular upper packing gland 12 retains the upper packing 7 in place. An oil tube 17 extends through the upper packing gland 12 and the upper packing box 5, thereby providing a means for introducing lubricating fluid into the rotary sealed bearing assembly.

The lower sealing assembly is similar to the upper sealing assembly. The lower outer bearing race 111B is held against the lower surface of the bearing housing shoulder 3A by an annular lower packing box 6, which is secured to the bearing housing 3. The lower inner bearing race 111A is held against the lower surface of the bearing sleeve shoulder 4A by an annular lower retaining nut 8. A lower packing 10 (preferred embodiments of which are described in further detail below) is interposed between lower retaining nut 8 and the lower packing box 6, to thereby prevent leakage of lubricating fluid from the assembly. An annular lower packing gland 13 retains the lower packing 10 in place. Additionally, a conventional stripper rubber 15 is attached to a lower end of the bearing sleeve 4 adjacent the lower packing gland 13, preferably by a conventional threaded connection.

Figure 14A:
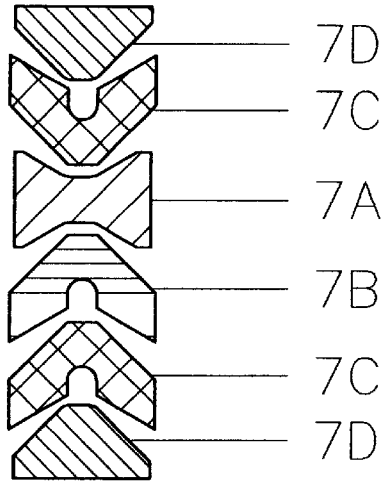
FIG. 14A is a side cross-section view of one preferred embodiment of an upper packing assembly.
Figure 14B:
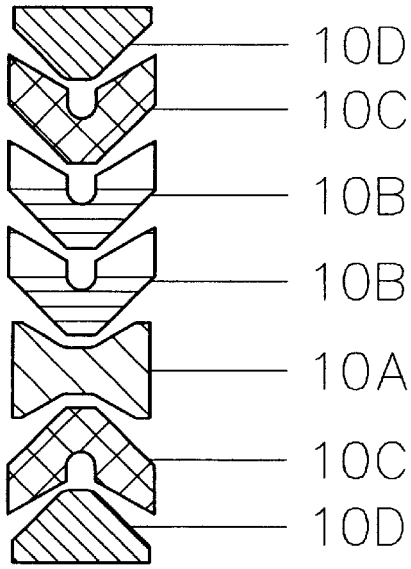
FIG. 14B is a side cross-section view of one preferred embodiment of a lower packing assembly.

Referring particularly to FIG. 14, the upper 7 and lower 10 packing preferably employ machined nylon lantern rings 7A, 10A and followers 7D, 10D, rather than conventional aluminum lantern rings and followers. Prior art drilling head assemblies employ roughcast aluminum followers and lantern rings, which have residual humps from the casting process. Aluminum followers and lantern rings also become permanently distorted during use, because aluminum has poor memory and is therefore unable to return to its original configuration after deformation. Humps and distortion both contribute to deficient sealing, and decrease the useful life of aluminum followers and lantern rings. The packing assembly of the present invention improves on the prior art drilling head assemblies by replacing the roughcast aluminum followers and lantern rings with machined nylon followers 7D, 10D and lantern rings 7A, 10A. The nylon followers 7D, 10D and lantern rings 7A, 10A are preferably machined from moly filed nylon, including most preferably 6PA–MO62 moly filled nylon (e.g. DELRIN moly filled nylon). A combination of high impact strength, abrasion resistance, and memory makes moly filled nylon an excellent substitute for metals in this application. The use of machined nylon followers 7D, 10D and lantern rings 7A, 10A in the upper 7 and lower 10 packings results in more uniform contact area between followers 7D, 10D and chevron packing rings 7B, 7C, 10B, 10C, which enhances the life of the packings 7, 10. During maintenance and replacement of the packings 7, 10, the followers 7D, 10D and lantern rings 7A, 10A can be reused. The resulting prolonged useful life of nylon followers and lantern rings is due in part to the memory of machined nylon, which returns to its original configuration after distortion. The use of machined nylon followers and lantern rings is known in the rotational pump arts, but as far as the inventor is aware has not been applied to drilling head assemblies.

The chevron packings 7B, 7C, 10B, 10C are preferably rubber or rubberized fabric, or a combination thereof. In a preferred embodiment shown in FIG. 14A, the upper packing 7 includes a nylon lower follower 7D, a rubberized fabric chevron packing ring 7C, a rubber chevron packing ring 7B, a nylon lantern ring 7A, an inverted rubberized fabric chevron packing ring 7C, and an inverted nylon upper follower 7D. In a preferred embodiment shown in FIG. 14B, the lower packing 10 includes a nylon lower follower 10D, a rubberized fabric chevron packing 10C, a nylon lantern ring 10A, a pair of inverted rubber chevron packing rings 10B, an inverted rubberized fabric chevron packing ring 10C, and an inverted nylon follower 7D.

The invention also overcomes certain problems associated with preloading of the bearings. Preloading causes excessive and immediate wear of the bearings in drilling head assemblies. Preloading occurs inadvertently either at the time of initial assembly or, more frequently, following a teardown and rebuild of the assembly during routine maintenance. The inventor has discovered that by using precise machining techniques of the type conventionally employed in fabricating rotary pumps, the rotary sealed bearing assembly can be configured such that it is impossible to preload the bearings. The components of the rotary sealed bearing assembly of FIG. 1 are machined so as to allow the inner bearing races 11A, 111A to be compressed against the shoulder 4A of the bearing sleeve 4, while at the same time providing a very tight range of play or clearance (preferably between about 0.006 to 0.014 inches) between the outer bearing races 11B, 111B, the shoulder 3A of the bearing housing 3, and the upper 5 and lower 6 packing boxes. Even with the inner bearing races 11A, 111A maximally compressed against the bearing sleeve shoulder 4A, the outer bearing races 11B, 111B have sufficient clearance to slide out of a preloading condition, thus making it is impossible to preload the bearings 11.

Figure 15:
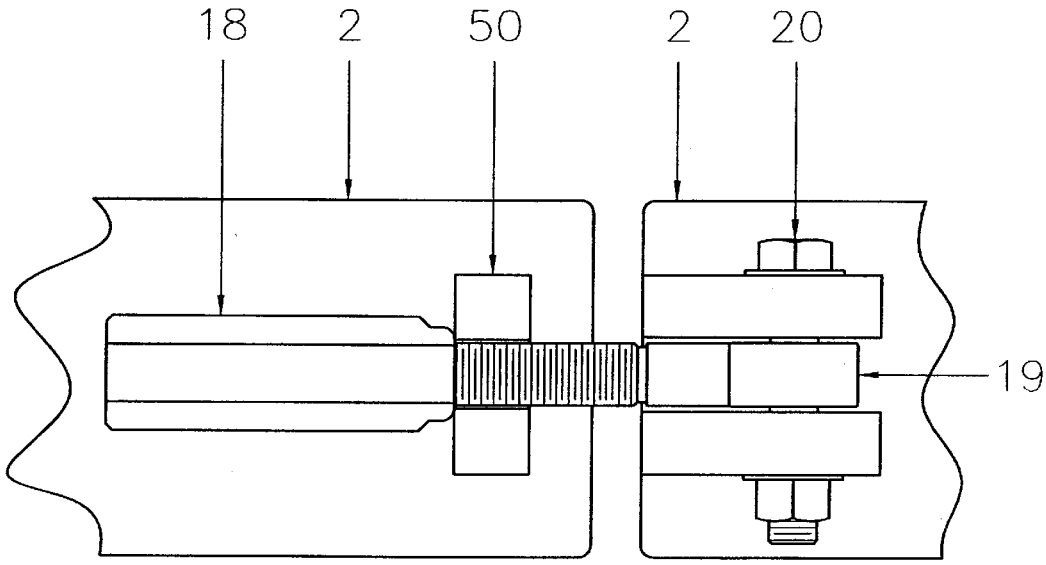
FIG. 15 is a detail view of one preferred embodiment of a latch mechanism for a drilling head assembly clamp.

As shown in FIGS. 1 and 15, a quick release clamp 2 is provided for facilitating installation and assembly at the well site. The use of such clamps is well known in the drilling head assembly art. The clamp is configured to fit over an upper end of the bowl 1 and to substantially encircle the bearing housing 3. The clamp assembly 2 has an upper beveled or lipped shoulder 28 and a lower beveled or lipped shoulder 30. When the clamp 2 is locked in position, the shoulders 28, 30 of the clamp are secured respectively to an upper shoulder 32 of the bearing housing 3 and to a beveled or lipped shoulder 34 of the bowl 1. The two jaws of the clamp assembly 2 are hinged together by a conventional hinge connection, such as a hinge pin 16. When the clamp assembly is properly fitted around the bowl 1 and the bearing housing 3, the unhinged ends of the two jaws of the clamp assembly can be selectively locked together by a conventional swing bolt arrangement, such as the preferred embodiment shown in FIG. 15. Swing bolt 19 is hinged to one of the unhinged ends of the jaws. The unhinged end of the other jaw is provided with a catch 50 positioned to receive the swing bolt 19. When swing bolt 19 is pivoted into the notch of the catch 50, the clamp assembly 2 can be tightened by screwing down swing bolt nut 18 against the catch 50. With the bearing housing 3 clamped to the bowl 1 in this manner, the bearing housing 3 will remain stationary with the bowl 1 and the well head components to which the bowl 1 is connected.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. An erosion resistant bowl apparatus for use in a drilling head assembly for drilling operations comprising:

a bowl member, said bowl member having a central receiving cavity configured to receive a rotary sealed bearing assembly, said bowl member having a discharge nozzle extending therefrom, said discharge nozzle fluidly communicating with said receiving cavity, and at least one diverter member extending from an inner surface of said receiving cavity of said bowl, said diverter member formed and configured to disrupt patterns of fluid flow within said bowl during drilling operations.

2. The apparatus of claim 1, further comprising at least one nozzle diverter member extending from an inner surface of said discharge nozzle.

3. The apparatus of claim 1, further comprising a first and a second nozzle diverter extending from an inner surface of said discharge nozzle.

4. The apparatus of claim 3, wherein said first and second nozzle diverters are positioned on opposing upper and lower inner surfaces of said discharge nozzle.

5. An erosion resistant bowl apparatus for use in a drilling head assembly for drilling operations comprising:

a bowl member, said bowl member having a central receiving cavity configured to receive a rotary sealed bearing assembly, said bowl member having a discharge nozzle extending therefrom, said discharge nozzle fluidly communicating with said receiving cavity, a plurality of diverter members extending from an inner surface of said receiving cavity of said bowl, said diverter members formed and configured to disrupt patterns of fluid flow within said bowl during drilling operations, wherein a first one of said diverter members is positioned substantially opposite said discharge nozzle, a second and third one of said diverter members are positioned on either side of said discharge nozzle, a fourth one of said diverter members is positioned between said first and second diverter members, and a fifth one of said diverter members is positioned between said first and third diverter members.

6. The apparatus of claim 5, further comprising at least one nozzle diverter member extending from an inner surface of said discharge nozzle.

7. The apparatus of claim 5, further comprising a first and a second nozzle diverter member extending from an inner surface of said discharge nozzle.

8. The apparatus of claim 7, wherein said first and second nozzle diverter members are positioned on opposing upper and lower inner surfaces of said discharge nozzle.

9. An erosion resistant bowl apparatus for use in a drilling head assembly for drilling operations comprising:

a bowl member, said bowl member having a central receiving cavity configured to receive a rotary sealed bearing assembly, said bowl member having a discharge nozzle extending therefrom, said discharge nozzle fluidly communicating with said receiving cavity, a central diverter extending from an inner surface of said receiving cavity, said central diverter positioned at about 180 degrees from a central axis of said discharge nozzle, a pair of first and second lower diverters extending from a lower portion of said inner surface of said receiving cavity on opposing sides of said discharge nozzle, a pair of first and second upper diverters extending from an upper portion of said inner surface of said receiving cavity on opposing sides of said discharge nozzle.

10. The apparatus of claim 9, wherein said upper diverters are closer to said central diverter than said lower diverters.

11. The apparatus of claim 9, wherein said lower diverters are closer to said central diverter than said upper diverters.

12. The apparatus of claim 9, wherein said first and second lower diverters are positioned at about 45 and 315 degrees, respectively, relative to said central axis of said discharge nozzle.

13. The apparatus of claim 9, wherein said first and second upper diverters are positioned about 60 and 300 degrees, respectively, relative to said central axis of said discharge nozzle.

14. The apparatus of claim 13, wherein said first and second nozzle diverters are positioned on opposing upper and lower inner surfaces of said discharge nozzle.

15. The apparatus of claim 9, further comprising at least one nozzle diverter member extending from an inner surface of said discharge nozzle.

16. The apparatus of claim 9, further comprising a first and a second nozzle diverter extending from an inner surface of said discharge nozzle.

17. A rotary drilling head assembly for a well bore comprising:

a bowl member, said bowl member having a central receiving cavity configured to receive a rotary sealed bearing assembly, said bowl member having a discharge nozzle extending therefrom, said discharge nozzle fluidly communicating with said receiving cavity, at least one diverter on an interior surface of said bowl, said diverter formed and configured to break up flow patterns of fluid within said bowl during drilling operations, a rotary sealed bearing assembly supported by said bowl, said rotary sealed bearing assembly comprising a stationary bearing housing, a bearing sleeve rotatably disposed in said bearing housing, a chamber provided between said stationary bearing housing and said rotatable bearing sleeve for receiving a lubricating fluid, a bearing means interposed between said bearing housing and said rotatable bearing sleeve and disposed within said chamber, and an upper and lower sealing means carried by said bearing housing and providing a seal for said chamber to substantially preclude leakage of said fluid from said rotary sealed bearing assembly.

18. The apparatus of claim 17, wherein said bowl has a plurality of said diverters, a first one of said diverters being positioned substantially opposite said discharge nozzle, a second and third one of said diverters being positioned on either side of said discharge nozzle, a fourth one of said diverters being positioned between said first and second diverters, and a fifth one of said diverters being positioned between said first and third diverters.

19. The apparatus of claim 17, further comprising at least one nozzle diverter member extending from an inner surface of said discharge nozzle.

20. The apparatus of claim 17, further comprising a first and a second nozzle diverter extending from an inner surface of said discharge nozzle.

21. The apparatus of claim 20, wherein said first and second nozzle diverters are positioned on opposing upper and lower inner surfaces of said discharge nozzle.

22. A rotary drilling head assembly for a well bore comprising:

a bowl member, said bowl member having a central receiving cavity configured to receive a rotary sealed bearing assembly, said bowl member having a discharge nozzle extending therefrom, said discharge nozzle fluidly communicating with said receiving cavity, a central diverter extending from an inner surface of said receiving cavity, said central diverter positioned at about 180 degrees from a central axis of said discharge nozzle, a pair of first and second lower diverters extending from a lower portion of said inner surface of said receiving cavity on opposing sides of said discharge nozzle, a pair of first and second upper diverters extending from an upper portion of said inner surface of said receiving cavity on opposing sides of said discharge nozzle, a rotary sealed bearing assembly supported by said bowl, said rotary sealed bearing assembly comprising a bearing housing, said bearing housing having an inwardly extending shoulder, said bearing housing positioned within said receiving cavity of said bowl, said bearing housing having a circumferential lower shoulder which sealingly engages an annular upper rim of said bowl when said bearing housing is positioned within said receiving cavity of said bowl, a bearing sleeve rotatably disposed in said bearing housing, said bearing sleeve having an outwardly extending shoulder, an upper bearing assembly and a lower bearing assembly sandwiched around said inwardly extending bearing housing shoulder and said bearing sleeve shoulder, an upper outer bearing race of said upper bearing assembly held against an upper surface of said inwardly extending bearing housing shoulder by an annular upper packing box, an upper inner bearing race of said upper bearing assembly held against an upper surface of said bearing sleeve shoulder by an annular upper retaining nut, an upper packing interposed between said upper retaining nut and said upper packing box to thereby prevent leakage of lubricating fluids from said rotary sealed bearing assembly, an annular upper packing gland retaining said upper packing in place, a lower outer bearing race of said lower bearing assembly held against a lower surface of said inwardly extending bearing housing shoulder by an annular lower packing box, a lower inner bearing race of said lower bearing assembly held against a lower surface of said bearing sleeve shoulder by an annular lower retaining nut, a lower packing interposed between said lower retaining nut and said lower packing box to thereby prevent leakage of lubricating fluid from said rotary sealed bearing assembly, and an annular lower packing gland retaining said lower packing in place.

23. The apparatus of claim 22, wherein said upper diverters are closer to said central diverter than said lower diverters.

24. The apparatus of claim 22, wherein said lower diverters are closer to said central diverter than said upper diverters.

25. The apparatus of claim 22, wherein said first and second lower diverters are positioned at about 45 and 315 degrees, respectively, relative to said central axis of said discharge nozzle.

26. The apparatus of claim 22, wherein said first and second upper diverters are positioned about 60 and 300 degrees, respectively, relative to said central axis of said discharge nozzle.

27. The apparatus of claim 22, further comprising at least one nozzle diverter member extending from an inner surface of said discharge nozzle.

28. The apparatus of claim 22, further comprising a first and a second nozzle diverter extending from an inner surface of said discharge nozzle.

29. The apparatus of claim 28, wherein said first and second nozzle diverters are positioned on opposing upper and lower inner surfaces of said discharge nozzle.

30. The assembly of claim 22, further comprising an oil tube extending through said upper packing gland and said upper packing box to thereby provide a means for introducing lubricating fluid into said rotary sealed bearing assembly.

31. The assembly of claim 22, further comprising a clamp assembly, said clamp assembly configured to selectively retain said bearing housing in said bowl.

32. The assembly of claim 22, wherein said upper and said lower packings each include a nylon lantern ring and a pair of nylon followers.

33. The assembly of claim 32, wherein said nylon lantern rings and said nylon followers are machined from moly filled nylon.

34. The assembly of claim 22, wherein preloading of said bearing assemblies is prevented by machining said rotary sealed bearing assembly such that when said inner bearing races are compressed against said bearing sleeve shoulder, a clearance is maintained between said outer bearing races, said bearing housing shoulder, and said upper and said lower packing boxes, whereby said outer bearing races have sufficient clearance to slide out of a preloading condition.

35. A rotary drilling head assembly for a well bore comprising:

a bowl member, said bowl member having a central receiving cavity configured to receive a rotary sealed bearing assembly, said bowl member having a discharge nozzle extending therefrom, said discharge nozzle fluidly communicating with said receiving cavity, at least one diverter on an interior surface of said bowl, said diverter formed and configured to break up flow patterns of fluid within said bowl during drilling operations, a rotary sealed bearing assembly supported by said bowl, said rotary sealed bearing assembly comprising a bearing housing, said bearing housing having an inwardly extending shoulder, said bearing housing positioned within said receiving cavity of said bowl, said bearing housing having a circumferential lower shoulder which sealingly engages an annular upper rim of said bowl when said bearing housing is positioned within said receiving cavity of said bowl, a bearing sleeve rotatably disposed in said bearing housing, said bearing sleeve having an outwardly extending shoulder, an upper bearing assembly and a lower bearing assembly sandwiched around said inwardly extending bearing housing shoulder and said bearing sleeve shoulder, an upper outer bearing race of said upper bearing assembly held against an upper surface of said inwardly extending bearing housing shoulder by an annular upper packing box, an upper inner bearing race of said upper bearing assembly held against an upper surface of said bearing sleeve shoulder by an annular upper retaining nut, an upper packing interposed between said upper retaining nut and said upper packing box to thereby prevent leakage of lubricating fluids from said rotary sealed bearing assembly, an annular upper packing gland retaining said upper packing in place, a lower outer bearing race of said lower bearing assembly held against a lower surface of said inwardly extending bearing housing shoulder by an annular lower packing box, a lower inner bearing race of said lower bearing assembly held against a lower surface of said bearing sleeve shoulder by an annular lower retaining nut, a lower packing interposed between said lower retaining nut and said lower packing box to thereby prevent leakage of lubricating fluid from said rotary sealed bearing assembly, and an annular lower packing gland retaining said lower packing in place.

36. The apparatus of claim 35, further comprising at least one nozzle diverter member extending from an inner surface of said discharge nozzle.

37. The assembly of claim 35, wherein said upper and said lower packings each include a nylon lantern ring and a pair of nylon followers.

38. The assembly of claim 37, wherein said nylon lantern rings and said nylon followers are machined from moly filled nylon.

39. The assembly of claim 35, wherein preloading of said bearing assemblies is prevented by machining said rotary sealed bearing assembly such that when said inner bearing races are compressed against said bearing sleeve shoulder, a clearance is maintained between said outer bearing races, said bearing housing shoulder, and said upper and said lower packing boxes, whereby said outer bearing races have sufficient clearance to slide out of a preloading condition.

* * * * *